US005826447A

United States Patent [19]

Campbell

[11] Patent Number: 5,826,447

[45] Date of Patent: Oct. 27, 1998

[54] PROCEDURE FOR HANDLING MATERIALS IN DRUMS AND BUNG-PLUG APPARATUS AND METHOD THEREFOR

[76] Inventor: Michael C. Campbell, 1400 Woodhouse Rd., Virgina Beach, Va. 23454

[21] Appl. No.: 762,344

[22] Filed: Dec. 9, 1996

[51] Int. Cl.[6] ..... B65D 55/14

[52] U.S. Cl. ..... 70/164; 70/230; 292/307 A

[58] Field of Search ..... 70/158–173, 57, 70/58, 229–232, 440, 439; 292/307 A

[56] References Cited

U.S. PATENT DOCUMENTS

| | | | |
|---|---|---|---|
| 1,555,759 | 9/1925 | Rowe . | |
| 1,586,298 | 5/1926 | Eaton | 70/230 X |
| 1,599,685 | 9/1926 | Spaeth . | |
| 4,223,799 | 9/1980 | Eyster et al. | 220/230 |
| 4,420,012 | 12/1983 | Astrom | 137/319 |
| 4,426,863 | 1/1984 | Gillette et al. | 70/164 |
| 4,655,060 | 4/1987 | Jakubas | 70/164 X |
| 4,700,866 | 10/1987 | Taylor | 220/316 |
| 4,788,840 | 12/1988 | Wilson, Jr, | 70/164 |
| 4,811,977 | 3/1989 | Swift et al. | 292/307 A |
| 4,959,980 | 10/1990 | Phillips | 70/164 X |
| 5,125,700 | 6/1992 | Fattori et al. | 292/307 A X |
| 5,199,286 | 4/1993 | Jakubas | 70/164 X |
| 5,524,945 | 6/1996 | Georgopoulos et al. | 292/307 A |
| 5,533,767 | 7/1996 | Georgopoulos et al. | 292/307 A X |
| 5,568,951 | 10/1996 | Morgan | 292/307 A |
| 5,596,892 | 1/1997 | Edgar et al. | 70/164 |

FOREIGN PATENT DOCUMENTS

| | | | |
|---|---|---|---|
| 417022 | 3/1991 | European Pat. Off. | 292/307 A |
| 550815 | 7/1993 | European Pat. Off. | 292/307 A |

*Primary Examiner*—Suzanne DinoBarrett
*Attorney, Agent, or Firm*—Griffin, Butler, Whisenhunt & Szipl, LLP

[57] ABSTRACT

A bung-plug lock apparatus for preventing a bung-plug (14, 16) from being unscrewed from a drum bung (12, 14) includes an elongated locking plate (38, 38') having a mounting portion (40, 40') for engaging the bung-plug and a locking portion (44, 44') extending radially outwardly from the bung-plug for contacting an inner surface of a raised rim of a drum to prevent the bung-plug from being rotated to unscrew it from the drum. The mounting portion has slots for receiving laterally positioned arms (34, 34') of a U-bracket (30, 30') attached in an external cavity of a standard bung plug. A retaining cable loop (52), having a unique serial number (62), passes through holes (50, 50') in the arms for retaining the locking plate on the bung plug. The locking plate can be turned over and used as a wrench for removing the bung plug. A method of handling hazardous waste in drums includes the steps of applying the bung-plug lock apparatus to a bung-plug of a drum and noting the unique serial number of the cable loop thereof in documentation setting forth the contents of the drum.

19 Claims, 3 Drawing Sheets

PROCEDURE FOR HANDLING MATERIALS IN DRUMS AND BUNG-PLUG APPARATUS AND METHOD THEREFOR

BACKGROUND OF THE INVENTION

This invention relates generally to the art of handling materials, especially hazardous materials, in drums and more specifically to bung-plugs for drums, such as 15, 30, and 55 gallon drums, used for storing and transporting materials, such as paint, and solvents, etc.

With the advent of stricter waste-disposal laws, both in the U.S. and other countries, costs for properly transporting and disposing of materials have become very important factors in "doing business". In the U.S., and in most developed countries, businesses and governmental entities are restricted by law from introducing environmentally-unfriendly, as well as unknown, chemicals into the environment. Such laws require conversion, or transformation, of the chemicals into environmentally friendly materials before they can be disposed of. However, in order to properly treat chemicals prior to disposing of them, one must first identify the chemicals so that he can ascertain a proper treatment for transforming the chemicals into environmentally friendly substances. Often, identifying the chemicals can be more costly than treating them. In this regard, many waste chemicals are stored and transported in large drums having bung-plugs. Such drums containing pollutant substances often remain in staging areas (and waste landfills) for long periods of time and/or are transported, along with many other drums. While these drums are being thusly maintained and/or transported, unauthorized individuals can, and often do, remove their bung-plugs and pour additional pollutants into them, sometimes called "cocktailing".

Of course, it is preferable that individual drums contain only compatible materials/chemicals, or at least only known, documented, chemicals. In this manner, those who are charged with disposing of the chemicals in the drums can immediately know how they should treat these chemicals without taking sample draws and profiling (analyzing) them. Government controls require a "tracking" of drums from cradle to grave (RCRA) by requiring accompanying documentation, or manifests, identifying materials in serial numbered drums. However, if chemicals can be poured into the drums by unauthorized individuals while the drums are being maintained and transported, even with identifying manifests, persons charged with disposing of the materials often cannot be sure of the identities of the contents of the drums and, therefore, must still analyze the contents. Even when "profiling" tests show that the drums do contain the chemicals they are documented to contain, these tests substantially increase the costs of disposing of the materials.

Thus, it is an object of this invention to provide a procedure for handling hazardous chemicals, and a bung-plug lock apparatus to be used therewith, which provides those charged with disposing of hazardous and non-hazardous chemicals with assurance that documented chemicals in drums have not been contaminated by unidentified chemicals so that further tests need not be run.

Over the years there have been a number of suggestions for constructing locking bung-plugs which can only be removed if one has a particular tool or key. Examples of such suggestions are found in U.S. Pat. Nos. 1,555,759 to Rowe, 1,599,685 to Spaeth, and 4,788,840 to Wilson. Systems disclosed in these patents have various shortcomings. One problem is that they all involve the use of padlocks. Good padlocks are quite expensive so that they increase the costs of the mechanisms considerably. Another difficulty with padlocks is that they require that all authorized people have available the proper keys for opening the padlocks. Such a requirement is usually impractical and unduly expensive logistically. For this reason, drums are often shipped without padlocks. Another problem with padlocks is that, if unauthorized persons get the keys, they can open the drums, pour unauthorized materials therein, and again close them; but yet parties responsible for the drums, or those charged with disposing of hazardous chemicals in the drums, cannot then recognize that the drums have been improperly accessed.

Therefore, it is another object of this invention to provide a procedure for handling hazardous chemicals and a bung-plug lock apparatus used therewith which is inexpensive, does not require padlocks and keys, and provides evidence that bung plugs have been improperly tampered with.

Still another difficulty with the bung plug assemblies of these U.S. patents (U.S. Pat. Nos. 1,555,759; 1,599,685; and 4,788,840), as well as with a bung-plug sold by C & H Products under the trademark "DRUM VAULT LOCK-OUTS" having a removable rod which catches on an outer lip of a drum, is that they all require totally unique bung plugs which cannot be removed by standard bung plug wrenches usually used today; thus, they are unduly expensive to manufacture and are inefficient to use (which also runs up costs). For example, the bung plug of Spaeth (U.S. Pat. No. 1,599,685) requires a completely new manufacture and it can only be gripped by an unusually large wrench (not a normal bung plug wrench).

Thus, it is an object of this invention to provide a locking bung plug which is based on off-the-shelf bung plugs, having exterior cavities which have laterally-positioned bung-wrench ears, which can be operated by a standard bung plug wrench.

Looking more closely at U.S. Pat. No. 1,599,685 to Spaeth, this patent also describes an embodiment which uses a wire loop secured by a lead seal extending through a single, centered, stud to hold a rotatable cover on a bung-plug, along with a padlock. The cover prevents the bung plug from being grasped for removal thereof. Presumably, if one wants to remove the cover for removing the bung-plug, he must remove the wire loop and thereby provide visible evidence of that fact by the wire loop being severed. Firstly, because of the other functions which this cover and the stud must perform (allowing the cover to rotate), it is highly doubtful that, acceptable tolerances for a reasonably-sized wire could be worked out for this structure such that the wire, by itself, could prevent someone from removing the cover. But just as significantly, the Spaeth system also has the disadvantage that unauthorized people can remove the wire loop and cover, remove the bung-plug, place unauthorized chemicals into the drum, and thereafter apply a new wire loop and seal, and authorized people will never know the difference.

It is therefore another object of this invention to provide a bung-plug lock apparatus which provides a reliable frangible seal for preventing removal of a bung plug and which also provides conclusive evidence that this seal has not been tampered with since it was applied by an authorized person.

Yet still another difficulty with prior bung-plug lock apparatus is that they require additional tools for removing the bung-plugs once the lock apparatus have been removed, such as a separate wrench.

Thus, it is an object of this invention to provide a bung-plug lock apparatus which, in addition to being removable by a standard bung-plug wrench, can also be removed using elements of the lock apparatus itself as a wrench.

SUMMARY OF THE INVENTION

According to principles of this invention, a bung-plug lock apparatus for preventing a bung-plug from being unscrewed from a drum bung includes an elongated locking plate having an mounting portion for engaging the bung-plug and a locking portion extending radially outwardly from the bung-plug for contacting an inner surface of a raised rim of the drum to prevent the bung-plug from being rotated to unscrew it from the drum. The mounting portion has slots for receiving laterally positioned arms of a bracket attached in an external cavity of a standard bung plug. A retaining cable loop, having a unique serial number, passes through holes in the arms for retaining the locking plate on the bung plug. The locking plate is a bent member with the mounting portion being in a plane approximately parallel with, but offset from, a plane of the locking portion, the engaging and locking portions being attached by an inclined, intermediate, portion extending between these two planes. The locking plate can be turned over and used as a wrench for removing the bung-plug once the wire loop is removed. In an enhanced embodiment, there is an indicator tag attached to the mounting portion which will indicate if someone has tried to bend the locking plate, thereby indicating that the locking plate has been tampered with.

A method of handling hazardous waste in drums includes the steps of applying the bung-plug lock apparatus to a bung-plug drum and noting the unique serial number of a wire loop seal thereof in documentation, or a manifest, setting forth the contents of the drum.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
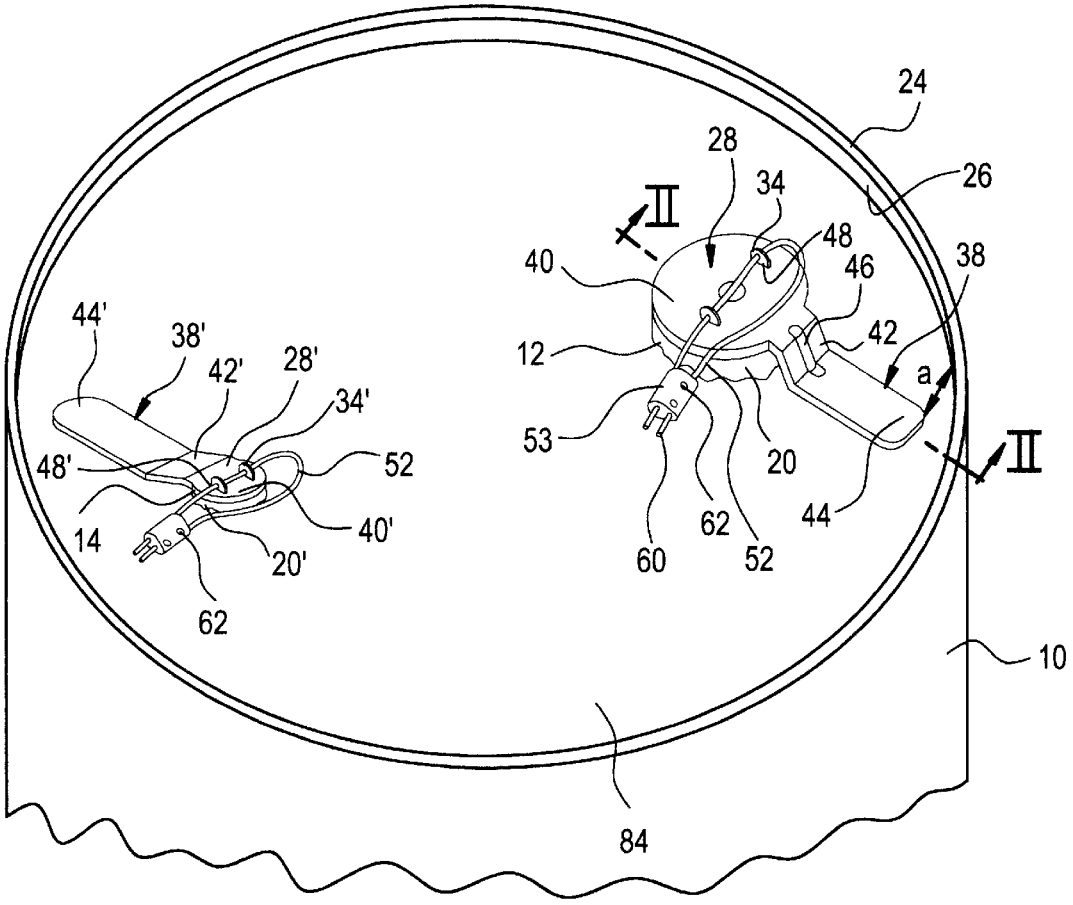
FIG. 1 is an isometric view of two bung-plug lock apparatus of this invention respectively on small and large bung-plugs of a drum.
Figure 2:
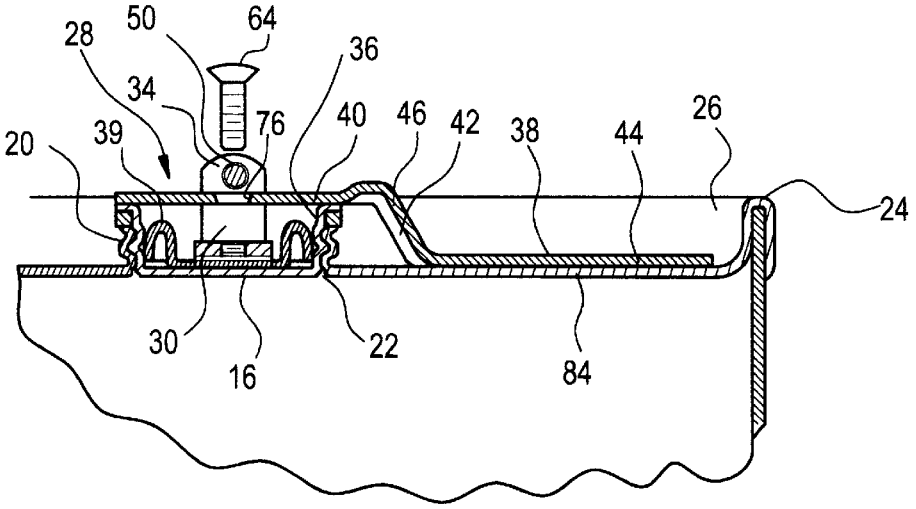
FIG. 2 is a cross sectional view taken on line II—II in FIG. 1.

Looking at FIG. 1, a 55 gallon drum has a large bung 12 and a small bung 14. A large bung-plug 16 (FIGS. 2 and 3) and a small bung-plug 18 (FIG. 4) are substantially covered up, and therefore cannot be seen, in FIG. 1. Each of the large bung 12 and the small bung 14 have a raised lip 20, 20' which, essentially, defines a bung hole 22 (FIG. 2). The raised rim 20 is shown in FIG. 2 as being part of the drum 10, however, this can also be separate from the rest of the drum 10. Similarly, the drum 10 has about its end perimeter a raised rim 24 with an inner surface 26 directed toward the large and small bungs 12 and 14.

Mounted on each of the large and small bungs 12 and 14 is bung-plug lock apparatus 28, 28'. In this respect, the bung-plug lock apparatus 28, 28' for the large and small bungs 12 and 14 contain substantially the same structure, thus, the same reference numerals are used for each of these apparatus, however, those reference numerals for the small bung-plug lock apparatus 28' have prime designations thereon. Similarly, the bung-plug lock apparatus for the large and small bungs 12 and 14 will be described together, in the singular, and then differences between these apparatus will be pointed out.

Figure 3:
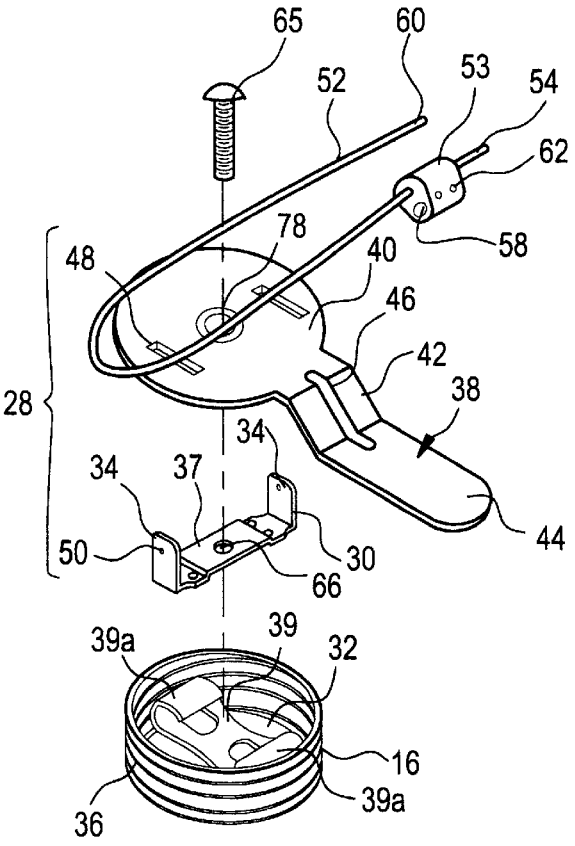
FIG. 3 is an exploded isometric view of a simplified bung-plug lock apparatus of this invention used in a procedure for handling hazardous chemicals of this invention.

The bung-plug lock apparatus 28, 28' includes a U-bracket 30, 30' welded at its ends to a floor 32, 32' in an external cavity of a normal bung-plug 16, 18. As can be seen in FIG. 2, laterally positioned arms 34, 34' of the U-bracket 30, 30' extend above a sidewall 36, 36' of the bung-plug 16, 18. Also as can be seen in FIGS. 2, and 3, the U-bracket 30 is welded at its ends while a bridge portion 37 thereof passes over a normal bung-plug wrench bracket 39 with a bung-plug wrench ears 39*a*.

Each bung-plug lock apparatus 28, 28' also includes a separate locking plate 38, 38'. The locking plate 38, 38' is formed by stamping at least a 16 gauge steel sheet to have the shape depicted in FIGS. 1–4. Namely, the locking plate 38, 38' has a mounting portion 40, 40' in one plane, an inclined intermediate portion 42, 42' placed at an angle, or incline, to the mounting portion 40, 40' and a locking portion 44, 44' which, as can be seen in FIG. 2, is in a plane which is approximately parallel to, but substantially spaced from, the plane in which the mounting portion 40, 40' is located. Further, the locking plate 38, 38' has an impressed rib 46 (only shown in the drawings for the locking plate 38 of the large bung-plug 16) stamped therein which extends from the locking portion 44, across the inclined intermediate portion 42, to the mounting portion 44. The impressed rib 46 adds stiffness to the locking plate 38 and allows a user to more easily recognize if the locking plate 38 has been tampered with. The locking plate 38, 38' also includes laterally-positioned slots 48, 48', in the mounting portion thereof which are spaced and sized to receive the laterally-positioned arms 34, 34' of the U-bracket 30, 30' so that when the mounting portion 40, 40' of the locking plate 38, 38' is placed on the bung-plug 16, 18, the arms 34, 34' extend through the slots 48, 48'. The arms 34, 34' have aligned holes 50, 50' therethrough which are positioned above the mounting portion 40, 40' when the mounting portion 40, 40' is on the bung-plug 16, 18 as shown in FIG. 1.

The bung-plug lock apparatus 28, 28' further includes a serial-numbered retaining cable 52. The retaining cable for the small bung-plug lock apparatus 28' is not designated using a prime reference numerals because the same type of retaining cables are used for both the small and large bung-plugs 14, 16. In this regard, each of the retaining cables 52, has attached at one end 54, thereof, a retaining clip 53. Each retaining clip 53 has a passage 58 therethrough for receiving a second end 60 of the retaining cable 52. Once the second end 60 of the retaining cable 52 is inserted through the locking passage 58, it cannot be removed therefrom without destroying the retaining cable 52. Such retaining cables are sold by a company named Brammal.

Further, each of the retaining clips 52 is numbered in a serial sequence with a serial number 62. None of the serial numbers for the retaining clips 53 of the retaining cables 52 is the same. That is, they all have different serial numbers.

Figure 4:
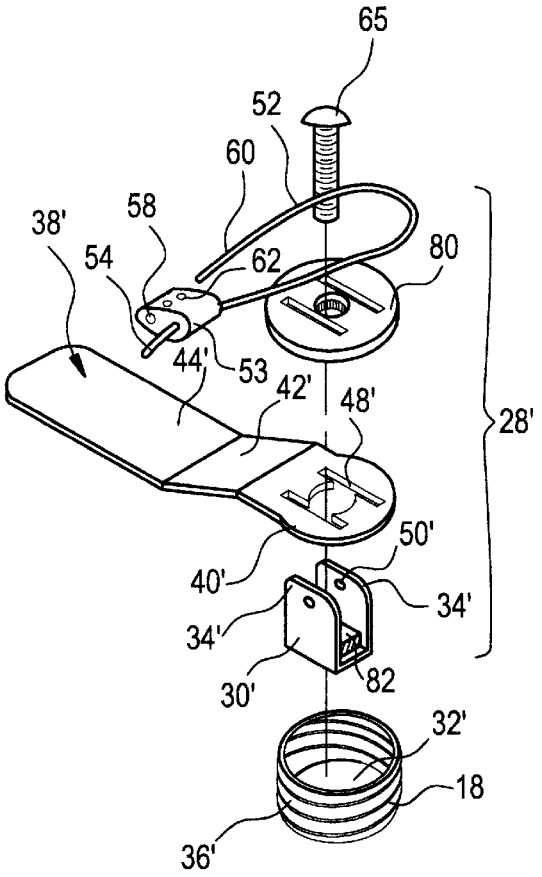
FIG. 4 is a view similar to that of FIG. 3, but of the bung-plug lock apparatus for the small bung-plug, and also including an optional cover plate.
Figure 5:
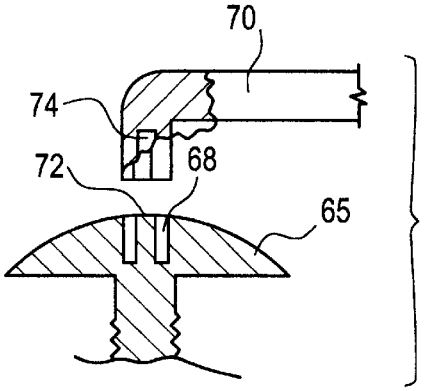
FIG. 5 is an exploded, partially cutaway, view of the optional bolt shown in FIGS. 3 and 4 with a special tool that is to be used therewith.

An enhancement of the bung-plug lock apparatus 28, 28' is a fastening screw 64 (FIG. 2) or 65 (shown in a slightly modified form in FIGS. 3 and 4). When the fastening screw 64, 65 is used, for the large bung-plug 16, a threaded hole 66 is placed in a raised base of the U-bracket 30 into which a threaded shaft of the fastening screw 64, 65 then engages. A head of the fastening screw 64, 65 is rounded and contains a special indentation 68 (FIG. 5), which can only be engaged by a special Allen wrench 70. In this regard, the special indentation 68 has a protrusion 72 located in the middle thereof and the special Allen wrench 70 must have a cavity 74 for receiving this protrusion 72 in order to be placed in the indentation 68. Further, the head of the fastening screw 64, 65 is inset into the mounting portion 40, 40'. In the FIG. 2 embodiment, an edge defining a hole 76 in the locking plate 38, through which the screw 64 passes, is beveled to correspond to a beveled lower surface of the screw head. Thus, the screw head does not extend substantially above the mounting portion 40 of the locking plate 38. In this manner, the head of the fastening screw 64 cannot be gripped with a wrench or pliers for removal so that the special Allen wrench 70 must be used to remove the fastening screw 64. In the embodiments depicted in FIGS. 3 and 4, the fastening screw 65 does not have a head with a lower beveled surface but rather a hole 78 in the mounting portion 40 has an inset shelf, either stamped or cut into the mounting portion 40, for "hiding" the head of the fastening screw 65.

The embodiment of the bung-plug lock apparatus 28' for the small bung-plug 18, shown in FIG. 4, is somewhat different in that a separate cover 80 is also included on top of the mounting portion 40', having slots aligned with the slots 48' and a hole for receiving the fastening screw 65. In this case, a separate insert 82 is welded in a crotch of the U-bracket 30 into which a threaded hole is cut for receiving the threaded shaft of the fastening screw 65 in the same manner as does the threaded hole 66 for the large bung-plug lock apparatus 28.

Describing now a procedure for handling hazardous chemicals and a method of using the bung-plug lock apparatus of this invention, an authorized first operator who is charged with putting hazardous chemicals into the drum 10 removes any retaining cable 52 extending through the holes 50, 50' of the U-brackets 30, 30' and lifts the locking plate 38, 38' from the bung-plug 14, 16 (it should be understood that the first operator could remove only one or both of the bung-plugs, as he desires). The first operator then inverts, or turns over, the locking plate 38, 38' from its position shown in FIGS. 1 & 2. The locking portion, 44, 44' of the locking plate 38, 38' is now positioned above the mounting portion 40, 40' and this locking portion 44, 44' can be gripped by the first operator for using the locking plate 38, 38' as a wrench. In this regard, the first operator manipulates the locking plate 38, 38' via the locking portion 44, 44' so that the mounting portion 40, 40' receives the arms 34, 34' of the U-bracket 30, 30' through its slots 48, 48'. The first operator then, thusly using the locking plate 38, 38' as a wrench, rotates the bung-plug 14, 16 to unscrew the bung-plug from the raised sidewall 20, 20' defining the bung hole 22. Once the bung-plug 14, 16 is removed from the bung hole 22 the first operator pours hazardous chemicals through the bung hole 22, into the drum 10. Once the first operator has done this, he again uses the locking plate 38, 38' as a wrench to screw the bung-plug 16, 18 into the raised sidewall 20 defining the bung hole 22. The first operator then inverts, or turns over the locking plate 38, 38' and places the mounting portion on top of the bung-plug 16, 18 so that the arms 34, 34' of the U-bracket 30, 30' extend through the slots 48, 48' in the mounting portion 40, 40'. When the locking plate 38, 38' is thusly placed on the bung-plug 16, 18, the locking portion 44, 44' comes in tight contact with a top wall 84, FIG. 2, of the drum 10. The first operator then inserts the second end 60 of a retaining cable 52 through the holes 50, 50' in the arms 34, 34' and inserts the second end 60 into the locking passage 58 of the retaining clip 53 which is attached to the first end 54 of the retaining cable 52. The retaining cable 52 now forms a loop passing through the arms 34, 34' above the locking plate 38, 38'. The tolerances of spaces between the slots 48, 48' and the arms 34, 34' are such that the locking plate 38, 38' cannot be moved above the point where the retaining cable 52 passes through the arms 34, 34'. Thus, once the second end of the retaining cable 52 has been inserted into the locking passage 58 of the retaining clip 53, the locking plate 38, 38' cannot be removed from the bung-plug 16, 18 unless the retaining cable 52 is cut or broken.

As can be seen in FIG. 1, when the locking plate 38, 38' is mounted in this manner, the locking portion 44, 44', which lies flat against the top wall 84 of the drum 10, can only be rotated a small distance before it contacts the inner surface 26 of the raised rim 24 of the drum 10. Thus, with the locking plate 38, 38' mounted on the bung-plug 16, 18 in this manner, the bung-plug cannot not unscrewed from the bung hole 22.

The first operator then notes on a manifest for the drum the serial number 62 on the retaining clip 53. This manifest, which is passed from a first authorized person to a second authorized person when custody of the drum is also similarly transferred, sets forth the hazardous materials contained in the drum 10 as well as the serial number of the retaining clip 56. This manifest is thus related to the drum 10, a separate document, identifying the drum in some other way (drums also have identifying numbers). Should an unauthorized person wish to open the bung-plug 16, 18 in order to place unauthorized chemicals into the drum 10, he would have to cut the retaining cable 52. If he does this, this retaining cable and its attached retaining clip, can no longer be used. Thus, a new retaining cable and retaining clip must be used with a new serial number. Thus, an authorized second operator, who is charged with handling the chemical materials in the drum 10 will know if someone tampered with the retaining cable 52. If the serial number of the retaining clip 53 is different from the serial number in the manifest, then there has been some tampering.

It may be possible, using tools, to deform the locking plate 38, 38' to such an extent that the locking portion 44, 44' can be rotated above the raised rim 24 of the drum 10. However, this will be difficult to do because of the strength of the material (steel) of which the locking plate 38, 38' is made and because the impressed rib 46 adds additional strength to the locking plate 38, 38'. Further, even if someone does bend the locking plate, the rib 46 may deform so that the authorized second operator can tell that the locking plate 38, 38' has been tampered with since the drum was handled by the first authorized operator, and will know that the chemical materials in the drum 10 must then be fully analyzed.

Figure 6:
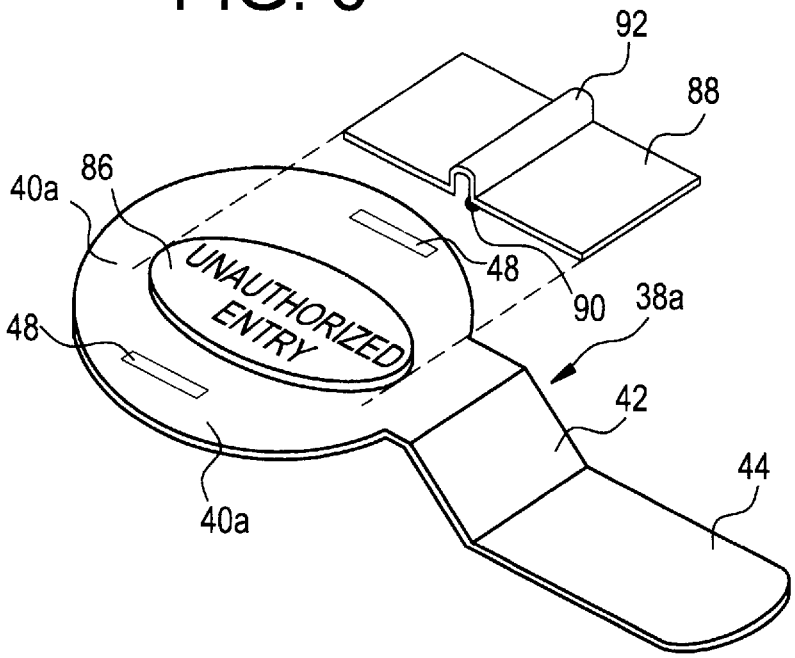
FIG. 6 is an exploded, isometric view of an enhanced version of a locking plate of a bung-plug lock apparatus of this invention, having a bend-indication tag thereon.
Figure 7:
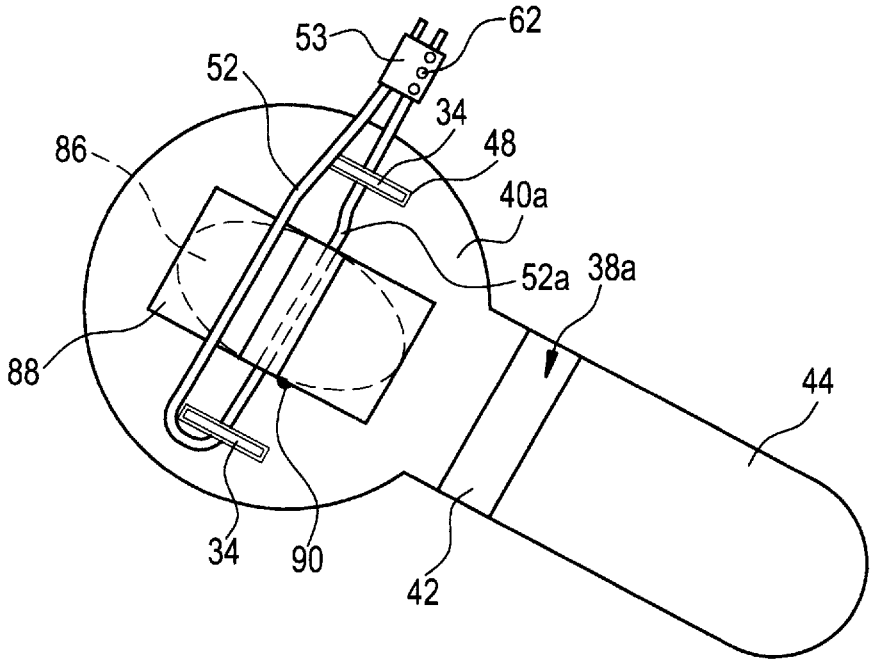
FIG. 7 is a top view of a bung-plug lock apparatus of this invention in a locking position with the enhanced locking plate of FIG. 6 thereon.

With regard to recognizing when an authorized person has tried to bend, or has actually bent, the locking plate **38*a*, an enhanced locking plate is depicted in FIGS. 6 and 7. This enhanced locking plate does not include the hole 78 for a fastening screw 65, although it could if it were desired. Otherwise, the locking plate 38***a* is substantially the same as the locking plate 38 depicted in the other drawings, although it has a paper or plastic label 86 and a bend-indication tag 88 on its top surface. The bend-indication tag is constructed of metal to be welded, or glued at an attachment point 90 to the mounting portion 40*a* of the locking plate 38*a*. The label 86 is glued to the mounting portion 40*a* so as to lie below the bend-indication tag 88 when the bend-indication tag 88 is attached, as can be seen in FIG. 7. The bend-indication tag 88 has a hump 92 therein aligned with centers of the slots 48. The label 86 in the depicted embodiment, has the words "UNAUTHORIZED ENTRY" thereon.

The purpose of the enhanced embodiment depicted in FIG. 7 is to provide authorized persons with an indication that someone has bent or at least tried to bend, the locking plate 38. In this regard, if someone were to try to bend the locking portion 44 upwardly so that the locking portion 44 would clear the raised rim 24 (see FIG. 1) of the drum, tests have shown that the locking plate 38*a* would bend along a line extending between centers of the arms 34, 34'; that is, along a portion 52*a* of the retaining cable 52 extending through the holes 50, 50' in the arms 34. The bend-indication tag 44 is properly mounted at the attachment point 90 by a tack-weld, or an appropriate glue, so that it will pop off of the mounting portion 40*a* of the locking plate 30*a* to uncover the label 86 and the words "UNAUTHORIZED ENTRY" when such a bend occurs.

It will be appreciated by those of ordinary skill in the art that this invention provides a highly beneficial procedure for handling hazardous chemicals whereby the identification of chemicals placed into a drum can be documented between authorized first, second; third, etc. operators Thus, the method and apparatus of this invention allows the documentation of cradle-to-grave responsibility for hazardous-material drums.

Further, it is beneficial that the locking plate of this invention is flat and bent to be positioned close to an end wall of the drum so as to contact an existing raised rim of a drum to prevent rotation of the bung-plug. In this manner, the locking plate, although relatively thin, cannot be easily bent. Also, it is not necessary to weld additional materials to the drum or that the drum be manufactured in an unusual manner. Further, the bung-plug lock apparatus of this invention can be used with a normal, off-the-shelf, slightly-modified drum.

Still another benefit of the bung-plug lock apparatus of this invention is that the locking plate thereof, because of its bent shape, is easily usable, not only to lock the bung-plug, but also as a wrench for screwing the bung-plug off and on.

It is extremely beneficial that the retaining cables, with their retaining clips, are labeled with distinctive, individual, serial numbers because in this manner these serial numbers can be matched with drum manifests, or titles (like car titles) and one can be assured that the bung-plugs have not been removed since last entries were made in the manifests.

The fastening screws, 64, and 65, of this invention along with the special Allen wrench 70 allow an additional method of retaining the locking plate 38, 38' to the bung-plug 16, 18. These fastening screws 64, 65 can be used separately or in addition to the retaining cable 52. For example, an operator who will have possession of the drum 10 for a number of days might wish to use the fastening screw 64, 65 during this period and only use a retaining cable 52 when he gives up custody of the drum 10. Of course, any operator who has custody of the drum 10 will have to sign the manifest that he verified the serial numbers when he received the drum and again when he gave up the drum.

Still another benefit of the bung-plug lock apparatus of this invention is that it is extremely inexpensive, and practical to manufacture and use. With regard to manufacture, the bung plugs used therewith are simply modified existing, off-the-shelf, bung plugs having exterior cavities and bung-plug wrench ears. That is, nothing is left off of off-the-shelf bung plugs, while only the U-brackets 30 are added thereto. Similarly, normal prior-art bung-plug wrenches can be used with these modified bung plugs; thus, the bung plugs of this invention can also be used in the same manner as were prior widely-used bung plugs. Also, the locking plate itself is a stamped flat article which can be cut from existing sheet steel.

Similarly, it is extremely beneficial that the modified bung plug has an exterior cavity with bung-plug wrench ears mounted on a floor defining the exterior cavity as well as a U-bracket with two arms offset on opposite sides of a center of the bung plug. The two arms extend out of the cavity for passing through slots in the locking plate when the locking plate is in the locking position. By constructing the bung plug in this manner a standard off-the-shelf lug wrench can still be placed on the bung plug and used in conjunction with the bung-plug wrench ears for screwing the bung plug. Also, as mentioned above, such a bung plug can be constructed by merely welding a U-bracket to prior-art standard bung plugs. Still further, by using two symmetrical arms offset from the center of the plug, rather than one center arm, the retaining cable holds the locking plate more securely on the bung plug.

Further regarding use of the bung-plug lock apparatus of this invention, each use only expends an inexpensive retaining cable. That is, there are is no requirements for an expensive padlock.

It is still further quite beneficial that authorized persons can easily recognize if unauthorized persons have tried to bend the locking plates of this invention, either because of damage to the rib 46 or because the bend-indication tag 88 has been popped off. A lack of such an indication provides authorized persons with conclusive evidence that no "cock-tailing" has taken place with a particular drum. It should be appreciated by those of ordinary skill in the art that there are other ways of providing bend-indications than using pop-off tags. For example, one could eliminate the pop-off tag 88 and only use a modified label 86. The modified label would have a surface which crumbles at the bend line between midpoints of the slots 48.

While the invention has been particularly shown and described with reference to a preferred embodiment, it will be understood by those of ordinary skill in the art that various changes in form and detail may be made therein without departing from the spirit and scope of the invention. For example, it would be possible to employ a serial numbered cable of this invention in a system and a process involving a serial numbered cable on a clamp holding a lid (rather than on a bung plug) on a drum. In this system and process, the serial numbered cable prevents the clamp from being opened so that the lid cannot be removed. Again the serial number is noted in a manifest. If the cable has been tampered with, or if the serial number on the cable is different from the number noted in the manifest, then an authorized person knows that an unauthorized person has had access to the drum and that the contents of the drum, therefore, must be tested.

The invention claimed is:

1. A drum-bung-plug lock apparatus for preventing a bung-plug screwed into a drum bung of a drum having a perimeter raised rim from being removed from the bung, said drum-bung lock apparatus comprising:

at least one arm rigidly attached to said bung plug and extending beyond the rest of said bung plug;

a flat elongated locking plate including an engaging mounting portion having at least one slot therein for receiving said arm and thereby keying rotation of said locking plate to said bung plug when said locking plate is placed in a locking position on said bung-plug so that said locking plate rotates with the bung-plug when said bung-plug is rotated to unscrew said bung-plug from said bung, said locking plate having a locking portion extending radially outwardly from said bung-plug, when said locking plate is in said locking position, and being located to contact an inner surface of said raised rim when said bung-plug is screwed from said bung to thereby prevent the bung-plug from being completely unscrewed from said bung; and a retaining mechanism for retaining said locking plate on said bung-plug in said locking position;

wherein said locking plate is elongated, having at one end said mounting portion being positioned in a first plane lying on a top surface of said bung-plug when said locking plate is in said locking position and a locking portion being positioned in a second plane, substantially parallel to but offset from said first plane, lying near an end wall of said drum from which said raised rim rises.

2. A drum-bung-plug lock apparatus as in claim 1 wherein said retaining mechanism is frangible and includes a serial number therein so that it can be recognized if the retaining mechanism has been removed and replaced.

3. A drum-bung-plug lock apparatus as in claim 2 wherein said retaining mechanism is a frangible cable which passes through arms on a bung-plug mounted bracket with which said locking plate is engaged in said locking position for retaining said locking plate on said bung-plug.

4. A drum-bung-plug lock apparatus as in claim 1 wherein there are two arms rigidly attached to said bung plug, said arms extending beyond any other portions of said bung plug, and wherein the engaging mounting portion of the elongated locking plate includes two slots for receiving said two arms to hold said mounting portion of said locking plate on said bung-plug in said locking position.

5. A drum-bung-plug lock apparatus as in claim 4 wherein the retaining mechanism is a cable which passes through holes in said arms.

6. A drum-bung-plug lock apparatus as in claim 5 wherein the cable is serially numbered with a distinctive number.

7. A drum-bung-plug lock apparatus as in claim 1 wherein said elongated locking plate is shaped and sized so that said elongated locking plate can be used as a wrench for engaging the bung-plug for screwing the bung-plug into and out of the drum-bung.

8. A drum-bung-plug lock apparatus as in claim 1, wherein the lock apparatus is only used with bung plugs having exterior cavities and wherein is further included a U-bracket for mounting on a floor in the exterior cavity to have at least two arms, offset from a center of the bung plug extending out of the cavity for passing through slots in said engaging mounting portion of the locking plate when the locking plate is in the locking position.

9. A drum-bung-plug lock apparatus as in claim 1 wherein is further included a separate bend-indication means adhered to the locking plate for indicating if the locking plate has been bent.

10. A drum-bung-plug lock apparatus as in claim 9 wherein the bend-indication means is placed in alignment with points of attachment of the engaging mounting portion with the bung-plug.

11. A drum-bung-plug lock apparatus as in claim 10 wherein said bend-indication means is a pop-off tag which is attached to the locking plate by a frangible attachment which releases when the locking plate is bent.

12. A method of locking a bung-plug on a drum having a raised rim employing the steps of:

attaching at least one arm rigidly to said bung plug so that said arm extends beyond the rest of said bung plug;

providing a flat elongated locking plate including an engaging mounting portion having at least one slot therein for receiving said arm and thereby keying rotation of said locking plate to said bung plug when said locking plate is placed in a locking position on said bung-plug so that said locking plate rotates with said bung-plug when said bung-plug is rotated to unscrew said bung-plug from a bung on said drum, said locking plate including a locking portion extending radially outward from said bung-plug when said locking plate is in said locking position and being located so as to contact an inner surface of said raised rim when said bung-plug is screwed from said bung to thereby prevent said bung-plug from being completely unscrewed from said bung; and retaining said locking plate on said bung-plug in said locking position with a retaining-cable loop having a distinctive serial number thereon so that said locking plate can only be removed from said bung by destroying said retaining cable loop;

wherein said locking plate provided is a bent member so that said locking portion lies in a plane which is offset from, but substantially parallel to, a plane in which a mounting portion on said bung plug lies.

13. A method of handling hazardous chemicals in a drum comprising the steps of:

applying a locking plate to a bung-plug for preventing said bung-plug from being rotated;

retaining the locking plate on the bung-plug by a frangible means which is serially numbered;

noting the serial number of the frangible means used for retaining the locking plate on the bung-plug in a drum manifest along with an identification of the chemicals;

comparing the serial number on the frangible means with the serial number noted in the drum manifest to ensure that the frangible means has not been replaced;

wherein the step of retaining the locking plate on the bung-plug by a frangible means includes the sub-step of using a frangible cable loop therefor; and wherein the step of applying a locking plate includes the sub-step of using a locking plate which is bent to have a mounting portion for contacting said bung plug positioned in a first plane and a locking portion positioned in a second plane offset from and approximately parallel to said first plane.

14. A drum bung-plug lock apparatus for preventing a bung-plug screwed into a drum bung of a drum from being removed from the bung, said drum-bung lock comprising:

at least two arms rigidly attached to said bung plug and extending beyond the rest of said bung plug;

a flat elongated locking plate including an engaging mounting portion having at least two slots therein for receiving said arms and thereby keying rotation of said locking plate to said bung plug when said locking plate is placed in a locking position on said bung-plug so that said locking plate rotates with the bung-plug when said bung-plug is rotated to unscrew said bung-plug from said bung, said locking plate preventing the bung plug from being completely unscrewed from said bung; and a retaining mechanism for retaining said locking plate on said bung-plug in said locking position;

wherein said lock apparatus can be used with bung plugs having an exterior cavity on a top side thereof with bung-plug wrench ears mounted in said cavity and said drum-bung lock comprises a U-bracket for being mounted in said cavity on a floor thereof to have at least two arms offset from a center of the bung plug, extending out of the cavity for passing through said slots in the locking plate when the locking plate is in the locking position.

15. A drum-bung-plug lock apparatus as in claim 14 wherein said retaining mechanism is frangible and includes a serial number thereon so that said retaining mechanism can be recognized.

16. A drum-bung-plug lock apparatus as in claim 14 wherein said retaining mechanism is a frangible cable which passes through the arms of the U-bracket.

17. A drum-bung-plug lock apparatus for preventing a bung-plug screwed into a drum bung of a drum having a perimeter raised rim from being removed from the bung, said drum-bung lock comprising:

at least one arm rigidly attached to said bung plug and extending beyond the rest of said bung plug;

a flat elongated locking plate including an engaging mounting portion having at least one slot therein for receiving said arm and thereby keying rotation of said locking plate to said bung plug when said locking plate is placed in a locking position on said bung-plug so that said locking plate rotates with the bung-plug when said bung-plug is rotated to unscrew said bung-plug from said bung, said locking plate having a locking portion extending radially outwardly from said bung-plug, when said locking plate is in said locking position, and being located to contact an inner surface of said raised rim when said bung-plug is screwed from said bung to thereby prevent the bung-plug from being completely unscrewed from said bung; and a retaining mechanism for retaining said locking plate on said bung-plug in said locking position;

wherein the lock apparatus is only used with bung plugs having exterior cavities and wherein is further included a U-bracket for mounting on a floor in the exterior cavity to have at least two arms, offset from a center of the bung plug extending out of the cavity for passing through slots in said engaging mounting portion of the locking plate when the locking plate is in the locking position.

18. A drum-bung-plug lock apparatus for preventing a bung-plug screwed into a drum bung of a drum having a perimeter raised rim from being removed from the bung, said drum-bung lock comprising:

at least one arm rigidly attached to said bung plug and extending beyond the rest of said bung plug;

a flat elongated locking plate including an engaging mounting portion having at least one slot therein for receiving said arm and thereby keying rotation of said locking plate to said bung plug when said locking plate is placed in a locking position on said bung-plug so that said locking plate rotates with the bung-plug when said bung-plug is rotated to unscrew said bung-plug from said bung, said locking plate having a locking portion extending radially outwardly from said bung-plug, when said locking plate is in said locking position, and being located to contact an inner surface of said raised rim when said bung-plug is screwed from said bung to thereby prevent the bung-plug from being completely unscrewed from said bung; and a retaining mechanism for retaining said locking plate on said bung-plug in said locking position;

wherein is further included a separate bend-indication means adhered to the locking plate for indicating if the locking plate has been bent.

19. A drum-bung-plug lock apparatus as in claim 18 wherein said bend indication means is a pop-off tag which is attached to the locking plate by a frangible attachment which releases when the locking plate is bent.

* * * * *